US007071238B2

(12) United States Patent
Gamlin et al.

(10) Patent No.: US 7,071,238 B2
(45) Date of Patent: Jul. 4, 2006

(54) FISCHER-TROPSCH PROCESS IN THE PRESENCE OF A COOLANT INTRODUCED INTO THE REACTOR SYSTEM

(75) Inventors: Timothy Douglas Gamlin, Woking (GB); Lawrence Trevor Hardy, Stockton on Tees (GB); David Newton, Farnham (GB)

(73) Assignees: BP Exploration Operating Company Limited, London (GB); Davy Process Technology Limited, London (GB)

( * ) Notice: Subject to any disclaimer, the term of this patent is extended or adjusted under 35 U.S.C. 154(b) by 179 days.

(21) Appl. No.: 10/476,798

(22) PCT Filed: May 17, 2002

(86) PCT No.: PCT/GB02/02346

§ 371 (c)(1),
(2), (4) Date: Nov. 6, 2003

(87) PCT Pub. No.: WO02/096841

PCT Pub. Date: Dec. 5, 2002

(65) Prior Publication Data

US 2004/0132838 A1 Jul. 8, 2004

(30) Foreign Application Priority Data

May 25, 2001 (GB) ..... 0112791.9

(51) Int. Cl.
*C07C 27/00* (2006.01)

(52) U.S. Cl. ..... 518/712; 518/711; 518/705; 518/700

(58) Field of Classification Search ..... 518/711, 518/712, 705, 700
See application file for complete search history.

(56) References Cited

U.S. PATENT DOCUMENTS

| | | | | |
|---|---|---|---|---|
| 2,438,029 | A | 3/1948 | Atwell | |
| 2,526,934 | A | 10/1950 | Clark | |
| 2,566,337 | A | 9/1951 | Kassel | |
| 5,409,960 | A * | 4/1995 | Stark | 518/700 |
| 5,939,350 | A | 8/1999 | Singleton et al. | |
| 5,961,933 | A | 10/1999 | Casanave et al. | |

FOREIGN PATENT DOCUMENTS

| | | | |
|---|---|---|---|
| GB | 728 543 | A | 4/1955 |
| WO | WO 01/38269 | A1 * | 5/2001 |

* cited by examiner

*Primary Examiner*—J. Parsa
(74) *Attorney, Agent, or Firm*—Nixon & Vanderhye

(57) ABSTRACT

Process for the conversion of synthesis gas to hydrocarbons, at least a portion of which are liquid at ambient temperature and pressure, by contacting the synthesis gas at an elevated temperature and pressure with a suspension comprising a particulate Fischer-Tropsch catalyst suspended in a liquid medium, in a reactor system comprising at least one high shear mixing zone and a reactor vessel. The process comprises passing the suspension and synthesis gas through the high shear mixing zone(s) where the synthesis gas is broken down into gas bubbles and/or irregularly shaped gas voids; discharging suspension having gas bubbles and/or irregularly shaped gas voids dispersed therein from the high shear mixing zone(s) into the reactor vessel; and introducing a liquid coolant into the reactor system.

25 Claims, No Drawings

FISCHER-TROPSCH PROCESS IN THE PRESENCE OF A COOLANT INTRODUCED INTO THE REACTOR SYSTEM

This application is the U.S. National Phase of International Application PCT/GB02/02346, filed 17 May 2002, which designated the U.S.

The present invention relates to a process for the conversion of carbon monoxide and hydrogen (synthesis gas) to liquid hydrocarbon products in the presence of a Fischer-Tropsch catalyst.

BACKGROUND OF THE INVENTION

In the Fischer-Tropsch synthesis reaction a gaseous mixture of carbon monoxide and hydrogen is reacted in the presence of a catalyst to give a hydrocarbon mixture having a relatively broad molecular weight distribution. This product is predominantly straight chain, saturated hydrocarbons which typically have a chain length of more than 2 carbon atoms, for example, more than 5 carbon atoms. The reaction is highly exothermic and therefore heat removal is one of the primary constraints of all Fischer-Tropsch processes. This has directed commercial processes away from fixed bed operation to slurry systems. Such slurry systems employ a suspension of catalyst particles in a liquid medium thereby allowing both the gross temperature control and the local temperature control (in the vicinity of individual catalyst particles) to be significantly improved compared with fixed bed operation.

Fischer-Tropsch processes are known which employ slurry bubble columns in which the catalyst is primarily distributed and suspended in the slurry by the energy imparted from the synthesis gas rising from the gas distribution means at the bottom of the slurry bubble column as described in, for example, U.S. Pat. No. 5,252,613.

The Fischer-Tropsch process may also be operated by passing a stream of the liquid medium through a catalyst bed to support and disperse the catalyst, as described in U.S. Pat. No. 5,776,988. In this approach the catalyst is more uniformly dispersed throughout the liquid medium allowing improvements in the operability and productivity of the process to be obtained.

We have recently found that a Fischer-Tropsch process may be operated by contacting synthesis gas with a suspension of catalyst in a liquid medium in a system comprising at least one high shear mixing zone and a reactor vessel. The suspension is passed through the high shear mixing zone(s) where synthesis gas is mixed with the suspension under conditions of high shear. The shearing forces exerted on the suspension in the high shear mixing zone(s) are sufficiently high that the synthesis gas is broken down into gas bubbles and/or irregularly shaped gas voids. Suspension having gas bubbles and/or irregularly shaped gas voids dispersed therein is discharged from the high shear mixing zone(s) into the reactor vessel where mixing is aided through the action of the gas bubbles and/or the irregularly shaped gas voids on the suspension. The suspension present in the reactor vessel is under such highly turbulent motion that any irregularly shaped gas voids are constantly coalescing and fragmenting on a rapid time scale, for example, over a time frame of up to 500 milliseconds, typically between 10 to 500 milliseconds. The transient nature of these irregularly shaped gas voids results in improved heat transfer and mass transfer of gas into the liquid phase of the suspension when compared with a conventional slurry bubble column reactor. Exothermic heat of reaction may be removed from the system by means of a heat exchanger. This process is described in WO 0138269 (PCT patent application number GB 0004444) which is herein incorporated by reference.

SUMMARY OF THE INVENTION

It has now been found that additional cooling can be achieved by introducing a liquid coolant into the reactor system.

Accordingly, the present invention relates to a process for the conversion of synthesis gas to hydrocarbons, at least a portion of which are liquid at ambient temperature and pressure, by contacting the synthesis gas at an elevated temperature and pressure with a suspension comprising a particulate Fischer-Tropsch catalyst suspended in a liquid medium, in a reactor system comprising at least one high shear mixing zone and a reactor vessel wherein the process comprises:

(a) passing the suspension and synthesis gas through the high shear mixing zone(s) where the synthesis gas is broken down into gas bubbles and/or irregularly shaped gas voids;

(b) discharging suspension having gas bubbles and/or irregularly shaped gas voids dispersed therein from the high shear mixing zone(s) into the reactor vessel; and (c) introducing a liquid coolant into the reactor system.

Without wishing to be bound by any theory, it is believed that introduction of a liquid coolant allows the temperature in the reactor vessel to be precisely controlled thereby providing improved control over product selectivities and minimizing the production of gaseous by-products, for example, methane.

The liquid coolant may be any liquid which is compatible with a Fischer-Tropsch synthesis reaction. Preferably, the liquid coolant which is to be introduced into the reactor system is at a temperature which is substantially below the temperature of the suspension in the reactor vessel. Preferably, the liquid coolant is at a temperature which is at least 25° C. below, preferably at least 50° C. below, more preferably at least 100° C. below the temperature of the suspension in the reactor vessel. Suitably, the liquid coolant is at a temperature of below 90° C., preferably from 20 to 90° C., more preferably 35 to 85° C., for example, 40 to 80° C., prior to being introduced to the reactor system. However, it is also envisaged that the liquid coolant may be cooled using refrigeration techniques before being introduced into the reactor system, for example, the liquid coolant may be cooled to a temperature below 15° C., more preferably, less than 10° C.

Preferably, the liquid coolant is a solvent which is capable of vaporizing under the process conditions (i.e. at an elevated temperature and pressure). Such a liquid coolant is hereinafter referred to as "vaporizable liquid coolant". Without wishing to be bound by any theory it is believed that the latent heat of vaporization of the vaporizable liquid coolant removes at least some of the exothermic heat of reaction from the system.

Suitably, the vaporizable liquid coolant has a boiling point, at standard pressure, in the range of from 30 to 280° C., preferably from 30 to 100° C. Preferably, the vaporizable liquid coolant is selected from the group consisting of aliphatic hydrocarbons having from 5 to 10 carbon atoms, cyclic hydrocarbons (such as cyclopentane and cyclohexane) alcohols (preferably, alcohols having from 1 to 4 carbon atoms, in particular, methanol and ethanol), ethers (for example, dimethyl ether), tetrahydrofuran, glycols and water (a by-product of the Fischer-Tropsch synthesis reaction). In order to simplify the process, it is preferred that the vaporizable liquid coolant is selected from the group consisting of low boiling liquid hydrocarbon products, such as hydrocarbon products having from 5 to 10 carbon atoms, in particular, pentanes, hexanes, or hexenes.

Suitably, the reactor vessel is a tank reactor or a tubular loop reactor.

The high shear mixing zone(s) may be part of the reactor system inside or outside the reactor vessel, for example, the high shear mixing zone(s) may project through the walls of the reactor vessel such that the high shear mixing zone(s) discharges its contents into the reactor vessel. Where, the high shear mixing zone(s) projects through the walls of the reactor vessel it may be necessary to recycle suspension from the reactor vessel to the high shear mixing zone(s) through a slurry line(s). Preferably, the reactor system comprises up to 250 high shear mixing zones, more preferably less than 100, most preferably less than 50, for example 10 to 50 high shear mixing zones. The high shear mixing zones may discharge into or may be located within a single reactor vessel as described in WO 0138269 (PCT patent application number GB 0004444). It is also envisaged that 2 or 3 such reactor systems may be employed in series.

Suitably, the shearing forces exerted on the suspension in the high shear mixing zone(s) are sufficiently high that at least a portion of the synthesis gas is broken down into gas bubbles having diameters in the range of from 1 μm to 10 mm, preferably from 30 μm to 3000 μm, more preferably from 30 μm to 300 μm.

Without wishing to be bound by any theory, it is believed that the irregularly shaped gas voids are transient in that they are coalescing and fragmenting on a time scale of up to 500 ms, for example, over a 10 to 50 ms time scale. The irregularly shaped gas voids have a wide size distribution with smaller gas voids having an average diameter of 1 to 2 mm and larger gas voids having an average diameter of 10 to 15 mm.

Suitably, the kinetic energy dissipation rate in the high shear mixing zone(s) is at least 0.5 $kW/m^3$ relative to the total volume of suspension present in the system, preferably in the range 0.5 to 25 $kW/m^3$, more preferably 0.5 to 10 $kW/m^3$, most preferably 0.5 to 5 $kW/m^3$, and in particular, 0.5 to 2.5 $kW/m^3$ relative to the total volume of suspension present in the system. Without wishing to be bound by any theory it is believed that when kinetic energy is dissipated to the suspension present in the high shear mixing zone(s) at a rate of at least 0.5 $kW/m^3$ relative to the total volume of suspension present in the system, the rate of mass transfer of synthesis gas to the suspension is enhanced.

Suitably, the volume of suspension present in the high shear mixing zone(s) is substantially less than the volume of suspension present in the reactor vessel, for example, less than 20%, preferably less than 10% of the volume of suspension present in the reactor vessel.

The high shear mixing zone(s) may comprise any device suitable for intensive mixing or dispersing of a gaseous stream in a suspension of solids in a liquid medium, for example, a rotor-stator device, an injector-mixing nozzle or a high shear pumping means.

The injector-mixing nozzle(s) can advantageously be executed as a venturi tube (c.f. "Chemical Engineers' Handbook" by J. H. Perry, $3^{rd}$ edition (1953), p. 1285, FIG. 61), preferably an injector mixer (c.f. "Chemical Engineers' Handbook" by J H Perry, $3^{rd}$ edition (1953), p 1203, FIG. 2 and "Chemical Engineers' Handbook" by R H Perry and C H Chilton $5^{th}$ edition (1973) p 6–15, FIGS. 6–31) or most preferably as a liquid-jet ejector (c.f. "Unit Operations" by G G Brown et al, $4^{th}$ edition (1953), p. 194, FIG. 210).

Alternatively, the injector-mixing nozzle may be executed as a venturi plate. The venturi plate may be positioned transversely within an open ended conduit which discharges suspension containing gas bubbles and/or irregularly shaped gas voids dispersed therein into the reactor vessel. Preferably, synthesis gas is injected into the open ended conduit downstream of the venturi plate, for example, within 1 meters, preferably, within 0.5 meters of the venturi plate.

The injector-mixing nozzle(s) may also be executed as a "gas blast" or "gas assist" nozzle where gas expansion is used to drive the nozzle (c.f. "Atomisation and Sprays" by Arthur H Lefebvre, Hemisphere Publishing Corporation, 1989). Where the injector-mixing nozzle(s) is executed as a "gas blast" or "gas assist" nozzle, the suspension of catalyst is fed to the nozzle at a sufficiently high pressure to allow the suspension to pass through the nozzle while the synthesis gas is fed to the nozzle at a sufficiently high pressure to achieve high shear mixing within the nozzle.

The high shear mixing zone(s) may also comprise a high shear pumping means, for example, a paddle or propeller having high shear blades positioned within an open ended conduit which discharges suspension containing gas bubbles and/or irregularly shaped gas voids into the reactor vessel. Preferably, the high shear pumping means is located at or near the open end of the conduit, for example, within 1 meter, preferably within 0.5 meters of the open end of the conduit. Synthesis gas may be injected into the conduit, for example, via a sparger, located immediately upstream or downstream, preferably upstream of the high shear pumping means, for example, within 1 meter, preferably, within 0.5 meters of the high shear pumping means. Without wishing to be bound by any theory, the injected synthesis gas is broken down into gas bubbles and/or irregularly shaped gas voids (hereinafter "gas voids") by the fluid shear imparted to the suspension by the high shear pumping means.

Where the injector mixing nozzle(s) is executed as a venturi nozzle (either a conventional venturi nozzle or as a venturi plate), the pressure drop of the suspension over the venturi nozzle is typically in the range of from 1 to 40 bar, preferably 2 to 15 bar, more preferably 3 to 7 bar, most preferably 3 to 4 bar. Preferably, the ratio of the volume of gas ($Q_g$) to the volume of liquid ($Q_1$) passing through the venturi nozzle is in the range 0.5:1 to 10:1, more preferably 1:1 to 5:1, most preferably 1:1 to 2.5:1, for example, 1:1 to 1.5:1 (where the ratio of the volume of gas ($Q_g$) to the volume of liquid ($Q_1$) is determined at the desired reaction temperature and pressure).

Where the injector mixing nozzle(s) is executed as a gas blast or gas assist nozzle, the pressure drop of gas over the nozzle is preferably in the range 3 to 100 bar and the pressure drop of suspension over the nozzle is preferably in the range of from 1 to 40 bar, preferably 4 to 15, most preferably 4 to 7. Preferably, the ratio of the volume of gas ($Q_g$) to the volume of liquid ($Q_1$) passing through the gas blast or gas assist nozzle(s) is in the range 0.5:1 to 50:1, preferably 1:1 to 10:1 (where the ratio of the volume of gas ($Q_g$) to the volume of liquid ($Q_1$) is determined at the desired reaction temperature and pressure).

The liquid coolant may be introduced directly into the high shear mixing zone(s) and/or the reactor vessel.

Where the reactor vessel is a tank reactor, suspension may be withdrawn from the tank reactor and may be, at least in part, recycled to the high shear mixing zones through an external conduit. Very good mixing may be achieved where the injector-mixing nozzle(s) is situated at the top of the tank reactor and the suspension recycle stream is withdrawn from the tank reactor at its bottom, as described in WO 0138269 (PCT patent application number GB 0004444).

The liquid coolant may be introduced into the system outside of the high shear mixing zone(s) and the tank reactor, for example, into the suspension recycle stream passing through the external conduit. Suitably, the suspension recycle stream is passed through the external conduit via a mechanical pumping means, for example, a slurry pump. Preferably, a heat exchanger is positioned on the external conduit to assist in removing exothermic heat of reaction from the system (hereinafter "external heat exchanger"). Preferably, the liquid coolant is introduced into the external conduit downstream of the external heat exchanger. It is envisaged that cooling may also be provided by means of an internal heat exchanger comprising cooling tubes, coils, or plates positioned within the suspension in the tank reactor. Thus, the reactor system may additionally comprise an external and/or an internal heat exchanger.

Preferably, the ratio of the volume of the external conduit (excluding the external heat exchanger) to the volume of the tank reactor is in the range of 0.005:1 to 0.2:1.

Where the process of the present invention takes place in a system comprising at least one high shear mixing zone, a tank reactor and an external conduit, the average residence time of the liquid component of the suspension in the system may be in the range from 10 minutes to 50 hours, preferably 1 to 30 hours. Suitably, the gas residence time in the high shear mixing zone(s) (for example, the injector-mixing nozzle(s)) is in the range 20 milliseconds to 2 seconds, preferably 50 to 250 milliseconds. Suitably, the gas residence time in the tank reactor is in the range 10 to 240 seconds, preferably 20 to 90 seconds. Suitably, the gas residence time in the external conduit is in the range 10 to 180 seconds, preferably 25 to 60 seconds.

For practical reasons the tank reactor may not be totally filled with suspension during the process of the present invention so that above a certain level of suspension a gas cap (containing unconverted synthesis gas, carbon dioxide, vaporized low boiling liquid hydrocarbons, vaporized water by-product, gaseous hydrocarbons having from 1 to 3 carbons atoms, vaporized liquid coolant, and any inert gases) is present in the top of tank reactor. Suitably, the volume of the gas cap is not more than 40%, preferably not more than 30% of the volume of the tank reactor. The high shear mixing zone may discharge into the tank reactor either above or below the level of suspension in the tank reactor.

Preferably, a gaseous recycle stream is withdrawn from the gas cap and is at least in part recycled to at least one high shear mixing zone(s). The gaseous recycle stream comprises unconverted synthesis gas, carbon dioxide, vaporized low boiling liquid hydrocarbons, vaporized water by-product, gaseous hydrocarbons having from 1 to 3 carbon atoms such as methane, ethane and propane, any vaporized liquid coolant, and any inert gases, for example, nitrogen. The gaseous hydrocarbons and vaporized low boiling liquid hydrocarbons are products of the Fischer-Tropsch synthesis reaction.

The gaseous recycle stream may be cooled before being recycled to the high shear mixing zone(s), for example, by passing the gaseous recycle stream through a heat exchanger, to assist in the removal of the exothermic heat of reaction from the system. Preferably, the gaseous recycle stream is cooled to below its dew point. Where the gaseous recycle stream is cooled to below its dew point, vaporized low boiling liquid hydrocarbons, vaporized water by-product and vaporized liquid coolant will condense out of the gaseous recycle stream. These condensed liquids are preferably separated from the gaseous recycle stream using a suitable separation means, for example, the heat exchanger may be fitted with a liquid trap. At least a portion of the condensed liquids may then be re-introduced to the system together with any fresh liquid coolant. Suitably, the condensed liquids may be subjected to further cooling (for example, using refrigeration techniques) before being re-introduced into the system. In order to prevent the build up of water by-product in the system it may be necessary to separate at least a portion of the condensed water from the condensed liquids, for example, using a decanter, before re-introducing the condensed liquids into the system. It is also envisaged that at least a portion of the condensed liquids may remain entrained in the gaseous recycle stream and may be introduced into the high shear mixing zone(s) entrained in the gaseous recycle stream. Fresh synthesis gas may be fed to the gaseous recycle stream, either upstream or downstream of the heat exchanger. Where the fresh synthesis gas has not been pre-cooled, the fresh synthesis gas is preferably fed to the gaseous recycle stream upstream of the heat exchanger. Preferably, the gaseous stream which is recycled to the high shear mixing zone(s) comprises from 5 to 50% by volume of fresh synthesis gas.

Preferably, a purge stream is taken from the gaseous recycle stream to prevent accumulation of gaseous by-products, for example, methane or carbon dioxide, or the build up of inert gases, for example, nitrogen, in the system. If desired, any gaseous intermediate products (for example, gaseous hydrocarbons having 2 or 3 carbon atoms) may be separated from the purge stream. Preferably, such gaseous intermediate products are recycled to the system where they may be converted to liquid hydrocarbon products. Preferably, fresh synthesis gas is introduced into the gaseous recycle stream downstream of the point of removal of the purge stream.

Where the reactor vessel is a tubular loop reactor comprising a tubular loop conduit, the high shear mixing zone(s) may be an injector-mixing nozzle(s), for example, of the types described above which discharge their contents into the tubular loop reactor. Suitably, the suspension may be circulated through the tubular loop reactor via at least one mechanical pumping means, for example, a paddle or propeller positioned therein. Preferably, a plurality of injector-mixing nozzles are spaced apart along the length of the tubular loop reactor. Preferably, a plurality of mechanical pumping means are spaced apart along the length of the tubular loop conduit. The liquid coolant may be introduced into either the injector-mixing nozzle (s) or the tubular loop reactor, preferably into the tubular loop reactor. Suitably, the liquid coolant is introduced into the tubular loop reactor upstream of the mechanical pumping means, for example, within 0.5 to 1.0 meters of the mechanical pumping means.

Alternatively, the tubular loop reactor may have at least one internal high shear mixing zone. Preferably, a plurality of such internal high shear mixing zones are spaced apart along the length of the tubular loop reactor. The internal high shear mixing zone(s) may comprise a section of the tubular loop reactor containing a high shear pumping means, for example, a paddle or propeller having high shear blades. Synthesis gas is introduced into this section of the tubular loop conduit, for example, via gas sparger. Preferably, the gas sparger is located in the section of tubular loop conduit upstream or downstream, preferably immediately upstream of the high shear pumping means, for example, within 1 meter, preferably within 0.5 meters of the high shear pumping means. Without wishing to be bound by any theory, the injected synthesis gas is believed to be broken down into gas bubbles and/or irregularly shaped gas voids by the fluid shear imparted to the suspension by the high shear pumping means. Suitably, the liquid coolant is introduced into the tubular loop reactor upstream of the high shear pumping means, for example within 0.5 to 1 meters of the high shear pumping means.

It is also envisaged that the internal high shear mixing zone(s) may comprise a section of the tubular loop reactor containing a venturi plate. Synthesis gas is introduced into the section of the tubular loop reactor, for example, via a gas sparger, which is preferably located immediately downstream of the venturi plate, for example, within 1 meter, preferably within 0.5 meters of the venturi plate. In this arrangement, it will be necessary to circulate the suspension around the tubular loop reactor via at least one mechanical pumping means; Preferably, the liquid coolant is introduced into the tubular loop reactor immediately upstream of the mechanical pumping means, for example, within 0.5 to 1 meters of the mechanical pumping means.

Where the system comprises at least one high shear mixing zone and a tubular loop reactor, the process of the present invention is preferably operated with an average residence time in the system of the liquid component of the suspension of between 10 minutes and 50 hours, preferably 1 to 30 hours. Suitably, the gas residence time in the high shear mixing zone(s) is in the range 20 milliseconds to 2 seconds, preferably 50 to 250 milliseconds. Suitably, the gas residence time in the tubular loop reactor (excluding any internal high shear mixing zone(s)) is in the range 10 to 420 seconds, preferably 20 to 240 seconds.

An external heat exchanger comprising a cooling jacket and/or an internal heat exchanger comprising cooling tubes, coils or plates may be disposed along at least part of the length of the tubular loop reactor, preferably along substantially the entire length of the tubular loop reactor thereby assisting in the removal of the exothermic heat of reaction.

The tubular loop reactor is preferably operated without a headspace in order to mitigate the risk of slug flow. Suspension together with entrained gases (gas bubbles and/or irregularly shaped gas voids) and/or dissolved gases may be withdrawn from the tubular loop reactor and may be passed to a gas separation zone where the entrained and/or dissolved gases are separated from the suspension. The separated gases comprise, for example, unconverted synthesis gas, carbon dioxide, gaseous hydrocarbons having from 1 to 3 carbon atoms, vaporized low boiling liquid hydrocarbons, vaporized water by-product, any vaporized liquid coolant and any inert gases. Suitably, the catalyst is maintained in suspension in the gas separation zone by means of a by-pass loop conduit having a mechanical pumping means located therein. Thus, suspension is continuously withdrawn from the gas separation zone and is, at least part, recycled to the gas separation zone through the by-pass loop conduit. The separated gases may be recycled to the high shear mixing zone(s) as described above for the tank reactor system. A purge stream may be taken from this gaseous recycle stream to prevent the build up methane, carbon dioxide and inert gases in the reactor system (as described above for the tank reactor system).

Preferably, the ratio of hydrogen to carbon monoxide in the synthesis gas used in the process of the present invention is in the range of from 20:1 to 0.1:1, especially 5:1 to 1:1 by volume, typically 2:1 by volume. The synthesis gas may contain additional components such as nitrogen, water, carbon dioxide and lower hydrocarbons such as unconverted methane.

The synthesis gas may be prepared using any of the processes known in the art including partial oxidation of hydrocarbons, steam reforming, gas heated reforming, microchannel reforming (as described in, for example, U.S. Pat. No. 6,284,217 which is herein incorporated by reference), plasma reforming, autothermal reforming, and any combination thereof. A discussion of a number of these synthesis gas production technologies is provided in "Hydrocarbon Processing" V78, N. 4, 87–90, 92–93 (April 1999) and "Petrole et Techniques", N. 415, 86–93 (July–August 1998). It is also envisaged that the synthesis gas may be obtained by catalytic partial oxidation of hydrocarbons in a microstructured reactor as exemplified in "IMRET 3: Proceedings of the Third International Conference on Microreaction Technology", Editor W Ehrfeld, Springer Verlag, 1999, pages 187–196. Alternatively, the synthesis gas may be obtained by short contact time catalytic partial oxidation of hydrocarbonaceous feedstocks as described in EP 0303438. Preferably, the synthesis gas is obtained via a "Compact Reformer" process as described in "Hydrocarbon Engineering", 2000, 5, (5), 67–69; "Hydrocarbon Processing", 79/9, 34 (September 2000); "Today's Refinery", 15/8, 9 (August 2000); WO 99/02254; and WO 200023689.

Preferably, the hydrocarbons produced in the process of the present invention comprise a mixture of hydrocarbons having a chain length of greater than 2 carbon atoms, typically, greater than 5 carbon atoms. Suitably, the hydrocarbons comprise a mixture of hydrocarbons having chain lengths of from 5 to about 90 carbon atoms. Preferably, a major amount, for example, greater than 60% by weight, of the hydrocarbons have chain lengths of from 5 to 30 carbon atoms. Suitably, the liquid medium comprises one or more hydrocarbons which are liquid under the process conditions.

The catalyst which may be employed in the process of the present invention is any catalyst known to be active in Fischer-Tropsch synthesis. For example, Group VIII metals whether supported or unsupported are known Fischer-Tropsch catalysts. Of these iron, cobalt and ruthenium are preferred, particularly iron and cobalt, most particularly cobalt.

A preferred catalyst is supported on a carbon based support, for example, graphite or an inorganic oxide support, preferably a refractory inorganic oxide support. Preferred supports include silica, alumina, silica-alumina, the Group IVB oxides, titania (primarily in the rutile form) and most preferably zinc oxide. The support generally has a surface area of less than about 100 $m^2/g$ but may have a surface area of less than 50 $m^2/g$ or less than 25 $m^2/g$, for example, about 5 $m^2/g$.

The catalytic metal is present in catalytically active amounts usually about 1–100 wt %, the upper limit being attained in the case of unsupported metal catalysts, preferably 2–40 wt %. Promoters may be added to the catalyst and are well known in the Fischer-Tropsch catalyst art. Promoters can include ruthenium, platinum or palladium (when not the primary catalyst metal), aluminium, rhenium, hafnium, cerium, lanthanum and zirconium, and are usually present in amounts less than the primary catalytic metal (except for ruthenium which may be present in coequal amounts), but the promoter:metal ratio should be at least 1:10. Preferred promoters are rhenium and hafnium.

The catalyst may have a particle size in the range 5 to 500 microns, preferably less than 5 to 100 microns, for example, in the range 5 to 30 microns.

Preferably, the suspension of catalyst discharged into the reactor vessel comprises less than 40% wt of catalyst particles, more preferably 10 to 30% wt of catalyst particles, most preferably 10 to 20% wt of catalyst particles.

Suitably, the process of the present invention is operated with a gas hourly space velocity (GHSV) in the range 100 to 40000 $h^{-1}$, more preferably 1000 to 30000 $h^{-1}$, most preferably 2000 to 15000, for example 4000 to 10000 $h^{-1}$ at normal temperature and pressure (NTP) based on the feed volume of synthesis gas at NTP.

The process of the invention is preferably carried out at a temperature of 180–380° C., more preferably 180–280° C., most preferably 190–240° C.

The process of the invention is preferably carried out at a pressure of 5–50 bar, more preferably 15–35 bar, generally 20–30 bar.

The process of the present invention can be operated in batch or continuous mode, the latter being preferred.

In a continuous process product suspension is continuously removed from the system and is passed to a suitable separation means, where liquid medium and liquid hydrocarbon products are separated from the catalyst. This purification stage is as described in WO 0138269 (PCT patent application number GB 0004444).

The hydrocarbon products from the purification stage may be fed to a hydrocracking stage as described in WO 0138269 (PCT patent application number GB 0004444).

EXAMPLE

Approximately 10 g of an activated particulate Fischer Tropsch catalyst (20% w/w cobalt on zinc oxide prepared by co-precipitation of cobalt nitrate and zinc nitrate with ammonium carbonate as described in, for example, U.S. Pat. No. 4,826,800 which is herein incorporated by reference) was transferred under an inert gas blanket to a 1 liter stirred tank reactor containing approximately 300 ml of squalane. After transfer, the stirrer was turned on and a synthesis gas mixture comprising hydrogen (54.1% volume), carbon monoxide (26.4% volume), carbon dioxide (10.3% volume) and nitrogen (9.2% volume) (hereinafter "feed stream") was admitted to the tank reactor at a space velocity of 6000 $hr^{-1}$ and the system pressure was increased to 425 psig. A gaseous stream was continuously removed from the tank reactor (hereinafter "exit stream") and was passed through a water cooled knock-out (KO) pot to the system pressure controller before exiting the system. The temperature was raised over a period of 4 hours to 180° C. and then increased in temperature at a rate of 2° C. every 3 hours to 220° C. The system was allowed to run under these conditions for a total on-stream time of 372.0 hours. Liquid pentane, at a rate of 0.5 ml/hr, was then introduced into the tank reactor (via a liquid feed pump) at a position below the level of the suspension. The liquid pentane was allowed to evaporate in the tank reactor. Liquid pentane injection was continued for 36.3 hours before stopping the liquid feed pump and allowing the system to operate under the conditions prior to liquid injection. It was observed that the reactor temperature rose by 1° C. under the same electrical heat input conditions when ceasing to feed liquid pentane illustrating that a significant amount of heat was removed from the system through evaporation of the liquid pentane. Analysis of the feed and exit gaseous streams was used to determine gas conversions, as detailed in the Table below.

TABLE

| Hours on Stream | GHSV ($hr^{-1}$) | Temp (° C.) | Pressure (psig) | Conversion (mole %) CO | Selectivity (Carbon mole %) FT Product | Productivity (g/liter/hr) FT Product |
|---|---|---|---|---|---|---|
| Prior to Pentane injection | | | | | | |
| 332 | 6000 | 220 | 431 | 11.0 | 87.4 | 109.3 |
| During Pentane injection | | | | | | |
| 402.5 | 6000 | 220 | 423 | 11.3 | 83.3 | 96.9 |
| After Pentane injection | | | | | | |
| 402.5 | 6000 | 221 | 427 | 13.8 | 85.7 | 121.8 |

The invention claimed is:

1. A process for the conversion of synthesis gas to hydrocarbons, at least a portion of which are liquid at ambient temperature and pressure, by contacting the synthesis gas at an elevated temperature and pressure with a suspension comprising a particulate Fischer-Tropsch catalyst suspended in a liquid medium, in a reactor system comprising at least one high shear mixing zone and a reactor vessel wherein the process comprises:

(a) passing the suspension and synthesis gas through the high shear mixing zone(s) where the synthesis gas is broken down into gas bubbles and/or irregularly shaped gas voids;

(b) discharging suspension having gas bubbles and/or irregularly shaped gas voids dispersed therein from the high shear mixing zone(s) into the reactor vessel; and (c) introducing a liquid coolant into the reactor system.

2. A process as claimed in claim 1 wherein the liquid coolant is introduced into the reactor system at a temperature which is at least 25° C. below the temperature of the suspension in the reactor vessel.

3. A process as claimed in claim 2 wherein the liquid coolant is introduced into the reactor system at a temperature which is at least 50° C. below the temperature of the suspension in the reactor vessel.

4. A process as claimed in claim 3 herein the liquid coolant is introduced into the reactor system at a temperature which is at least 100° C. below the temperature of the suspension in the reactor vessel.

5. A process as claimed in claim 2 wherein the liquid coolant is introduced into the system at a temperature below 90° C.

6. A process as claimed in claim 5 the liquid coolant is introduced into the reactor system at a temperature in the range 35 to 85° C.

7. A process as claimed in claim 2 herein the liquid coolant is cooled using refrigeration techniques to a temperature below 15° C.

8. A process as claimed in claim 1 wherein the liquid coolant is a solvent which is capable of vaporizing in the reactor system under the conditions of elevated temperature and pressure.

9. A process as claimed in claim 8 wherein the vaporizable liquid coolant has a boiling point, at standard pressure, in the range of from 30 to 100° C.

10. A process as claimed in claim 8 wherein the vaporizable liquid coolant is selected from the group consisting of aliphatic hydrocarbons having from 5 to 10 carbon atoms, cyclic hydrocarbons, alcohols having from 1 to 4 carbon atoms, ethers, tetrahydrofuran, and water.

11. A process as claimed in claim 10 wherein the cyclic hydrocarbons are selected from cyclopentane and cyclohexane, the alcohols having from 1 to 4 carbon atoms are selected from methanol and ethanol, and the ether is dimethyl ether.

12. A process as claimed in claim 1 wherein the liquid coolant is introduced into the high shear mixing zone(s) and/or the reactor vessel.

13. A process as claimed in claim 1 wherein the reactor system comprises up to 250 high shear mixing zones.

14. A process as claimed in claim 1 wherein the reactor vessel is a tank reactor or a tubular loop reactor.

15. A process as claimed in claim 1 wherein the high shear mixing zone(s) projects through the walls of the reactor vessel or is located within the reactor vessel.

16. A process as claimed in claim 1 wherein the high shear mixing zone(s) comprises an injector-mixing nozzle.

17. A process as claimed in claim 16 where the injector-mixing nozzle(s) is a venturi nozzle.

18. A process as claimed in claim 17 wherein the pressure drop of the suspension over the venturi nozzle is in the range of from 1 to 15 bar and wherein the ratio of the volume of gas ($Q_g$) to the volume of liquid ($Q_1$) passing through the venturi nozzle is in the range 1:1 to 5:1 where the ratio of the volume of gas ($Q_g$) to the volume of liquid (Q1) is determined at the desired reaction temperature and pressure.

19. A process as claimed in claim 16 wherein the injector-mixing nozzle(s) is a gas blast nozzle.

20. A process as claimed in claim 19 wherein the pressure drop of gas over the nozzle is in the range 3 to 100 bar, the pressure drop of suspension over the nozzle is in the range of 4 to 15 bar and wherein the ratio of the volume of gas ($Q_g$) to the volume of liquid ($Q_1$) passing through the nozzle is in the range 1:1 to 10:1 where the ratio of the volume of gas ($Q_g$) to the volume of liquid (Q1) is determined at the desired reaction temperature and pressure.

21. A process as claimed in claim 1 wherein the reactor vessel is a tank reactor, and the liquid coolant is introduced into a suspension recycle stream passing through an external conduit.

22. A process as claimed in claim 21 wherein an external heat exchanger is positioned on the external conduit and/or an internal heat exchanger is positioned within the suspension in the tank reactor.

23. A process as claimed in claim 1 wherein the reactor vessel is a tubular loop reactor, the high shear mixing zone(s) comprises a section of the tubular loop reactor containing a high shear pumping means and synthesis gas is injected into said region of the tubular loop reactor immediately upstream or downstream of the high shear pumping means.

24. A process as claimed in claim 1 wherein the reactor vessel is a tubular loop reactor, the high shear mixing zone(s) comprises a section of the tubular loop reactor containing a venturi plate and synthesis gas is injected into said region of the tubular loop reactor immediately downstream of the venturi plate.

25. A process as claimed in claim 23 wherein an external heat exchanger and/or internal heat exchanger is disposed along at least part of the length of the tubular loop reactor.

* * * * *